US008978388B2

(12) United States Patent
Flanagan et al.

(10) Patent No.: US 8,978,388 B2
(45) Date of Patent: Mar. 17, 2015

(54) LOAD MEMBER FOR TRANSITION DUCT IN TURBINE SYSTEM

(75) Inventors: James Scott Flanagan, Simpsonville, SC (US); Jeffrey Scott LeBegue, Simpsonville, SC (US); Kevin Weston McMahan, Greer, SC (US); Ronnie Ray Pentecost, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 846 days.

(21) Appl. No.: 13/152,638

(22) Filed: Jun. 3, 2011

(65) Prior Publication Data

US 2012/0304653 A1 Dec. 6, 2012

(51) Int. Cl.

| | |
|---|---|
| ***F23R 3/60*** | (2006.01) |
| ***F23R 3/42*** | (2006.01) |
| ***F23R 3/00*** | (2006.01) |
| ***F01D 9/02*** | (2006.01) |
| ***F01D 25/28*** | (2006.01) |

(52) U.S. Cl.

CPC ..... *F23R 3/425* (2013.01); *F23R 3/002* (2013.01); *F23R 3/60* (2013.01); *F01D 9/023* (2013.01); *F01D 25/28* (2013.01); *F05D 2260/30* (2013.01); *F05D 2250/314* (2013.01)

USPC ..... 60/796; 60/752

(58) Field of Classification Search

CPC ..... F23R 3/60; F23R 3/002; F23R 3/48; F01D 9/023; F02C 7/20; Y02T 50/671

USPC ..... 60/796, 797, 798, 799, 800, 752, 753, 60/754, 755, 756, 757, 758, 759, 760, 60/39.37; 415/134, 135, 136, 137, 138, 415/139

See application file for complete search history.

(56) References Cited

U.S. PATENT DOCUMENTS

| | | | | | |
|---|---|---|---|---|---|
| 1,599,457 | A | * | 9/1926 | Chaleil | 239/424 |
| 2,729,938 | A | * | 1/1956 | McDowall et al. | 60/39.37 |
| 3,609,968 | A | * | 10/1971 | Mierley et al. | 60/799 |
| 3,657,882 | A | * | 4/1972 | Hugoson | 60/798 |
| 3,759,038 | A | * | 9/1973 | Scalzo et al. | 60/800 |
| 4,422,288 | A | | 12/1983 | Steber | |
| 4,432,207 | A | * | 2/1984 | Davis et al. | 60/723 |
| 5,077,967 | A | | 1/1992 | Widener et al. | |
| 5,118,120 | A | | 6/1992 | Drerup et al. | |
| 5,149,250 | A | * | 9/1992 | Plemmons et al. | 415/209.3 |

(Continued)

FOREIGN PATENT DOCUMENTS

| | | | |
|---|---|---|---|
| CN | 1525049 | A | 9/2004 |
| CN | 1526918 | A | 9/2004 |

(Continued)

*Primary Examiner* — Phutthiwat Wongwian
*Assistant Examiner* — Michael B Mantyla
(74) *Attorney, Agent, or Firm* — Dority & Manning, P.A.

(57) ABSTRACT

A loading assembly for a turbine system is disclosed. The loading assembly includes a transition duct and a load member. The transition duct extends between a fuel nozzle and a turbine section, and has an inlet, an outlet, and a passage extending between the inlet and the outlet and defining a longitudinal axis, a radial axis, and a tangential axis. The outlet of the transition duct is offset from the inlet along the longitudinal axis and the tangential axis. The load member extends from the transition duct and is configured to transfer a load between the transition duct and an adjacent transition duct along at least one of the longitudinal axis, the radial axis, or the tangential axis.

20 Claims, 8 Drawing Sheets

(56) References Cited

U.S. PATENT DOCUMENTS

| | | | | |
|---|---|---|---|---|
| 5,249,920 | A * | 10/1993 | Shepherd et al. | 415/134 |
| 5,414,999 | A | 5/1995 | Barnes | |
| 5,457,954 | A | 10/1995 | Boyd et al. | |
| 5,592,820 | A | 1/1997 | Alary et al. | |
| 5,761,898 | A | 6/1998 | Barnes et al. | |
| 5,839,283 | A | 11/1998 | Dübbeling | |
| 5,934,687 | A | 8/1999 | Bagepalli et al. | |
| 6,202,420 | B1 | 3/2001 | Zarzalis et al. | |
| 6,203,025 | B1 | 3/2001 | Hayton | |
| 6,442,946 | B1 | 9/2002 | Kraft et al. | |
| 6,450,762 | B1 * | 9/2002 | Munshi | 415/138 |
| 6,471,475 | B1 | 10/2002 | Sasu et al. | |
| 6,537,023 | B1 | 3/2003 | Aksit et al. | |
| 6,564,555 | B2 | 5/2003 | Rice et al. | |
| 6,652,229 | B2 | 11/2003 | Lu | |
| 6,662,567 | B1 | 12/2003 | Jorgensen | |
| 6,712,581 | B2 * | 3/2004 | Florjancic et al. | 415/135 |
| 6,932,568 | B2 | 8/2005 | Powis et al. | |
| 6,969,233 | B2 | 11/2005 | Powis et al. | |
| 7,007,480 | B2 | 3/2006 | Nguyen et al. | |
| 7,024,863 | B2 | 4/2006 | Morenko | |
| 7,181,914 | B2 | 2/2007 | Pidcock et al. | |
| 7,249,462 | B2 * | 7/2007 | Aumont et al. | 60/796 |
| 7,584,620 | B2 | 9/2009 | Weaver et al. | |
| 7,637,110 | B2 | 12/2009 | Czachor et al. | |
| 7,677,026 | B2 | 3/2010 | Conete et al. | |
| 7,721,547 | B2 | 5/2010 | Bancalari et al. | |
| 7,744,096 | B2 * | 6/2010 | Kono | 277/644 |
| 8,322,146 | B2 | 12/2012 | Rizkalla et al. | |
| 8,418,475 | B2 * | 4/2013 | Tanimura et al. | 60/796 |
| 2003/0039542 | A1 * | 2/2003 | Cromer | 415/135 |
| 2010/0037617 | A1 | 2/2010 | Charron et al. | |
| 2010/0037618 | A1 | 2/2010 | Charron et al. | |
| 2010/0037619 | A1 * | 2/2010 | Charron | 60/752 |
| 2010/0061837 | A1 * | 3/2010 | Zborovsky et al. | 415/58.4 |
| 2010/0115953 | A1 | 5/2010 | Davis, Jr. et al. | |
| 2010/0180605 | A1 | 7/2010 | Charron | |
| 2011/0259015 | A1 | 10/2011 | Johns et al. | |
| 2012/0111521 | A1 * | 5/2012 | Bullied et al. | 164/62 |
| 2012/0304653 | A1 | 12/2012 | Flanagan et al. | |
| 2012/0304665 | A1 | 12/2012 | LeBegue | |

FOREIGN PATENT DOCUMENTS

| | | | |
|---|---|---|---|
| CN | 101031713 | A | 9/2007 |
| EP | 1903184 | A2 | 3/2008 |

* cited by examiner

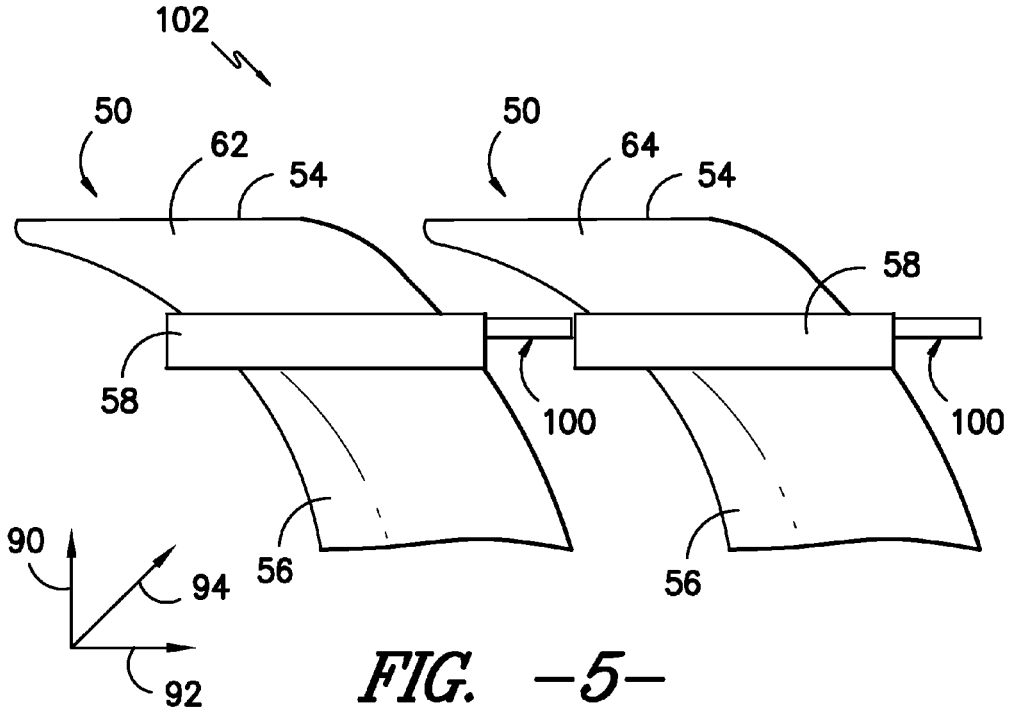
FIG. –5–
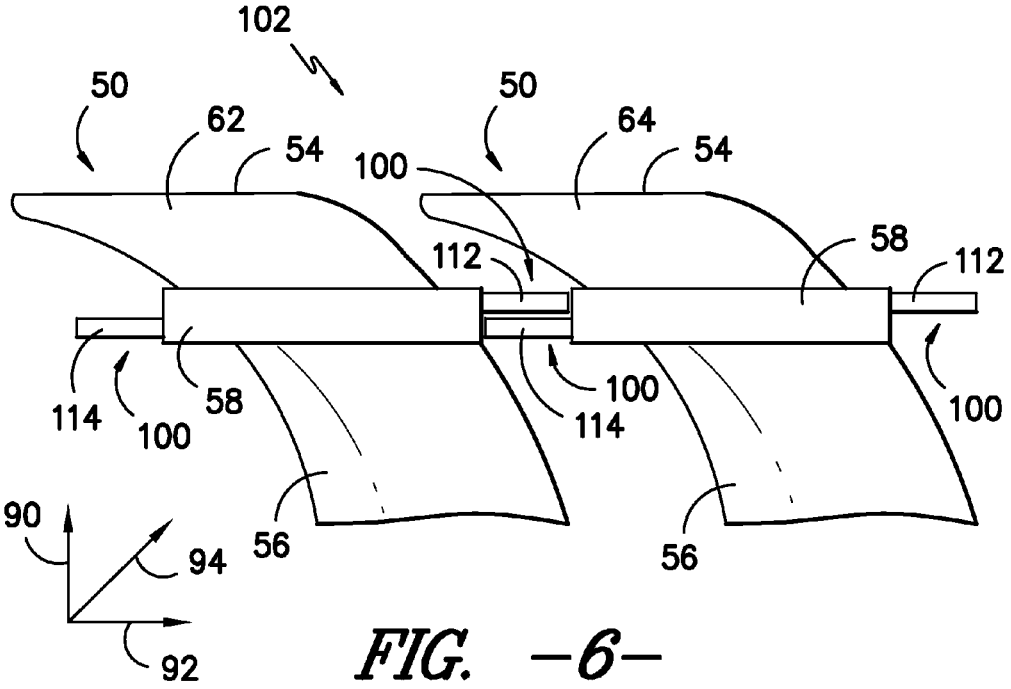
FIG. –6–

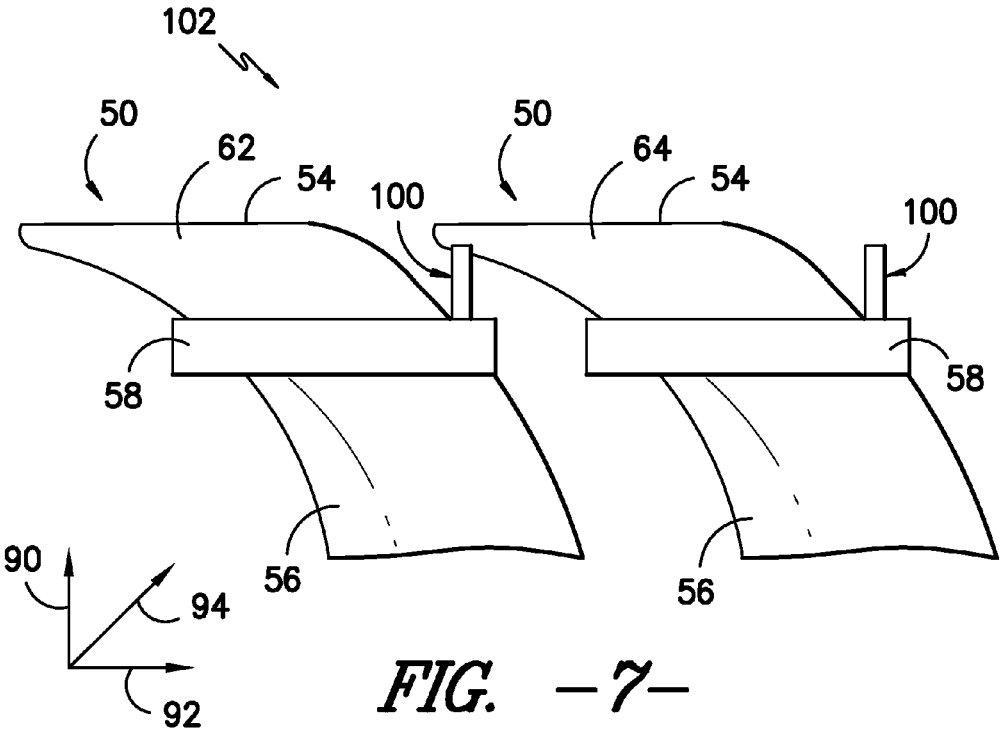
FIG. –7–
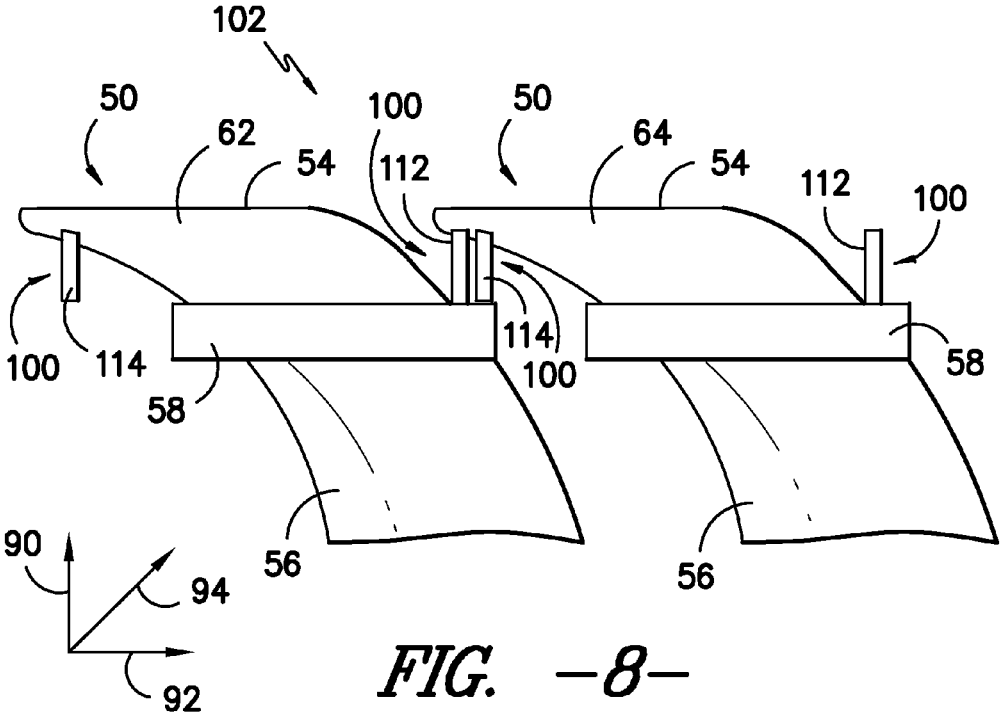
FIG. –8–

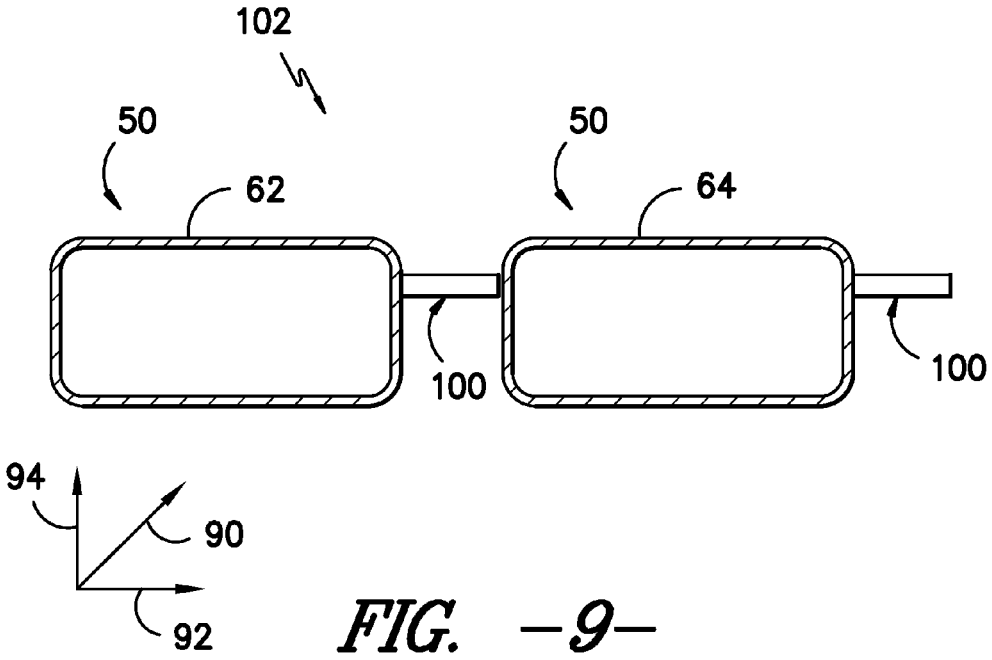
FIG. –9–
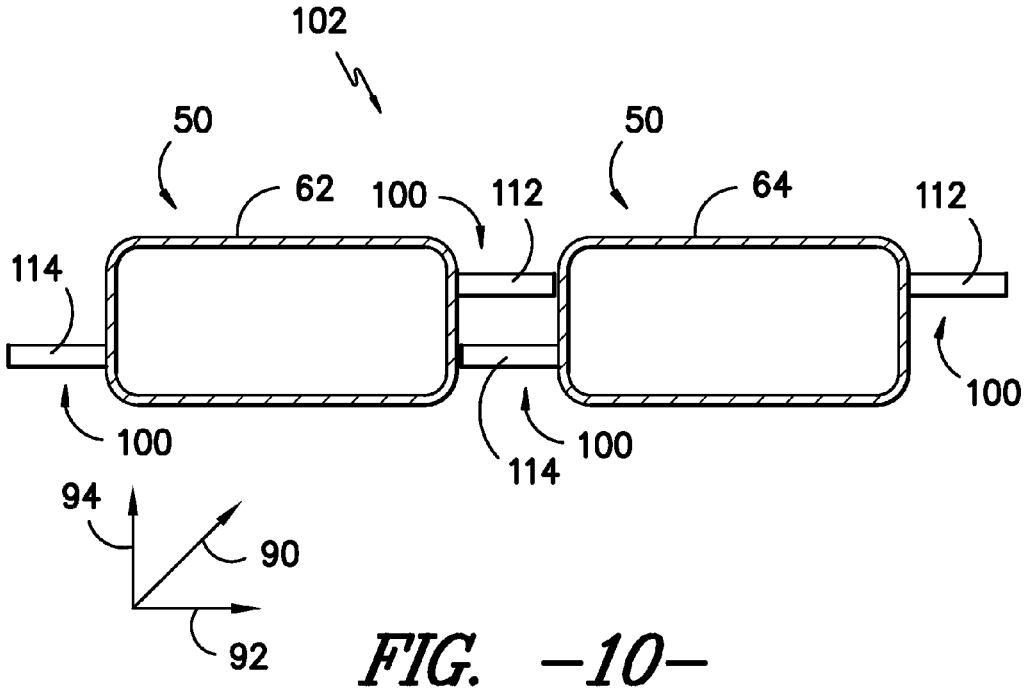
FIG. –10–

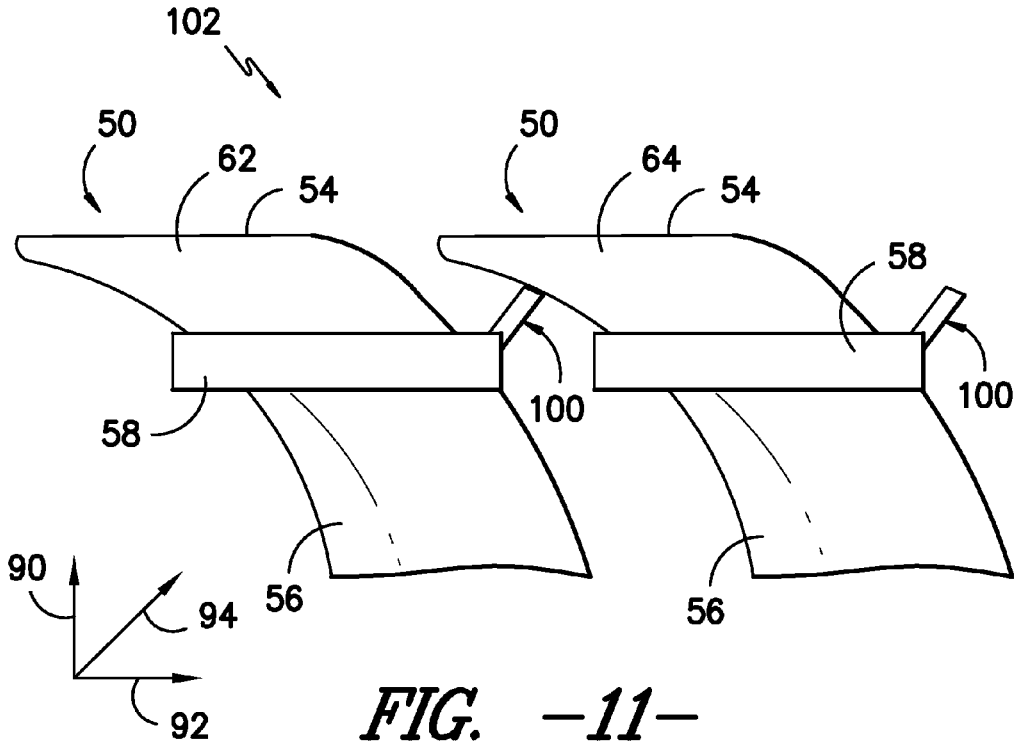
FIG. –11–
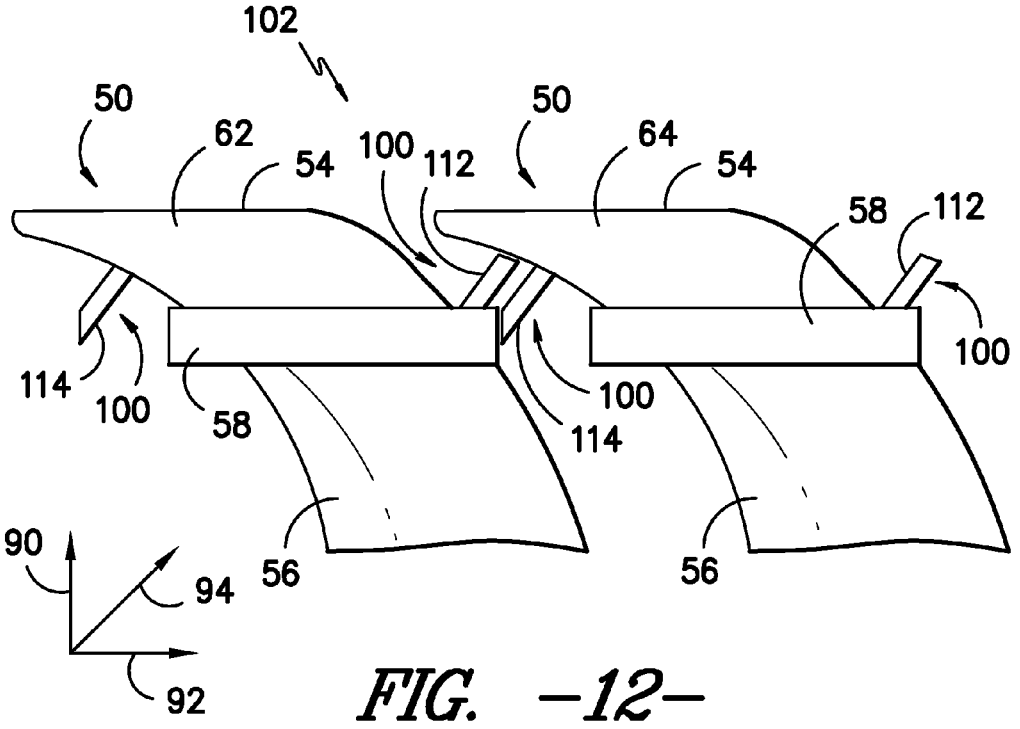
FIG. –12–

LOAD MEMBER FOR TRANSITION DUCT IN TURBINE SYSTEM

FIELD OF THE INVENTION

The subject matter disclosed herein relates generally to turbine systems, and more particularly to load members and loading assemblies for transition ducts in turbine systems.

BACKGROUND OF THE INVENTION

Turbine systems are widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to power the compressor, an electrical generator, and other various loads.

The compressor sections of turbine systems generally include tubes or ducts for flowing the combusted hot gas therethrough to the turbine section or sections. Recently, compressor sections have been introduced which include tubes or ducts that shift the flow of the hot gas. For example, ducts for compressor sections have been introduced that, while flowing the hot gas longitudinally therethrough, additionally shift the flow radially or tangentially such that the flow has various angular components. These designs have various advantages, including eliminating first stage nozzles from the turbine sections. The first stage nozzles were previously provided to shift the hot gas flow, and may not be required due to the design of these ducts. The elimination of first stage nozzles may eliminate associated pressure drops and increase the efficiency and power output of the turbine system.

However, the movement and interaction of adjacent ducts in a turbine system is of increased concern. For example, because the ducts do not simply extend along a longitudinal axis, but are rather shifted off-axis from the inlet of the duct to the outlet of the duct, thermal expansion of the ducts can cause undesirable shifts in the ducts along or about various axes. These shifts can cause stresses and strains within the ducts, and may cause the ducts to fail. Further, loads carried by the ducts may not be properly distributed and, when shifting occurs, the loads may not be properly transferred between the various ducts.

Thus, an improved load member and loading assembly for ducts in a turbine system would be desired in the art. For example, a load member and loading assembly that allow for thermal growth of the duct and transfer loads between adjacent ducts would be advantageous.

BRIEF DESCRIPTION OF THE INVENTION

Aspects and advantages of the invention will be set forth in part in the following description, or may be obvious from the description, or may be learned through practice of the invention.

In one embodiment, a loading assembly for a turbine system is disclosed. The loading assembly includes a transition duct extending between a fuel nozzle and a turbine section. The transition duct has an inlet, an outlet, and a passage extending between the inlet and the outlet and defining a longitudinal axis, a radial axis, and a tangential axis. The outlet of the transition duct is offset from the inlet along the longitudinal axis and the tangential axis. The mounting assembly further includes a load member extending from the transition duct. The load member is configured to transfer a load between the transition duct and an adjacent transition duct along at least one of the longitudinal axis, the radial axis, or the tangential axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 5 is a top view of a loading assembly according to one embodiment of the present disclosure;

FIG. 6 is a top view of a loading assembly according to another embodiment of the present disclosure;

FIG. 7 is a top view of a loading assembly according to another embodiment of the present disclosure;

FIG. 8 is a top view of a loading assembly according to another embodiment of the present disclosure;

FIG. 9 is a rear view of a loading assembly according to one embodiment of the present disclosure;

FIG. 10 is a rear view of a loading assembly according to another embodiment of the present disclosure;

FIG. 11 is a top view of a loading assembly according to one embodiment of the present disclosure; and FIG. 12 is a top view of a loading assembly according to another embodiment of the present disclosure.

DETAILED DESCRIPTION OF THE INVENTION

Figure 1:
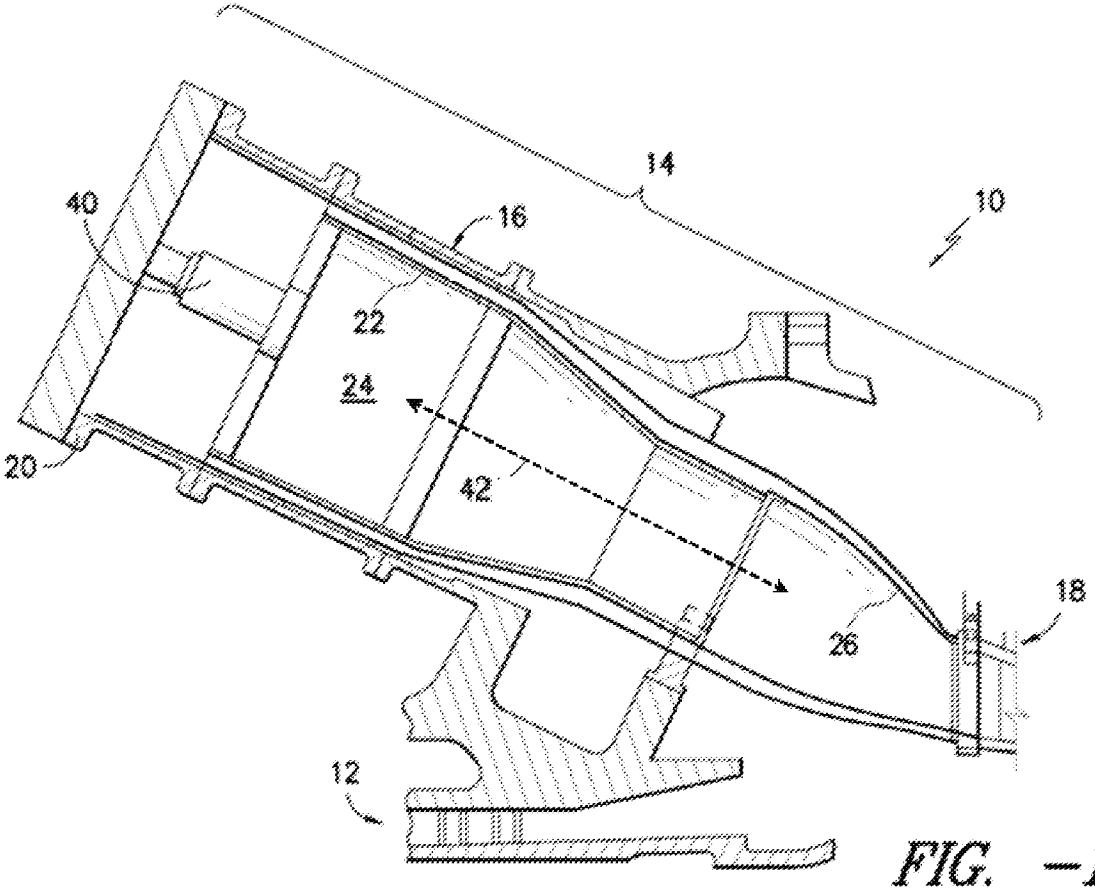
FIG. 1 is a cross-sectional view of several portions of a gas turbine system according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring to FIG. 1, a simplified drawing of several portions of a gas turbine system 10 is illustrated. It should be understood that the turbine system 10 of the present disclosure need not be a gas turbine system 10, but rather may be any suitable turbine system 10, such as a steam turbine system or other suitable system.

The gas turbine system 10 as shown in FIG. 1 comprises a compressor section 12 for pressurizing a working fluid, discussed below, that is flowing through the system 10. Pressurized working fluid discharged from the compressor section 12 flows into a combustor section 14, which is generally characterized by a plurality of combustors 16 (only one of which is illustrated in FIG. 1) disposed in an annular array about an axis of the system 10. The working fluid entering the combustor section 14 is mixed with fuel, such as natural gas or another suitable liquid or gas, and combusted. Hot gases of combustion flow from each combustor 16 to a turbine section 18 to drive the system 10 and generate power.

A combustor 16 in the gas turbine 10 may include a variety of components for mixing and combusting the working fluid and fuel. For example, the combustor 16 may include a casing 20, such as a compressor discharge casing 20. A variety of sleeves, which may be axially extending annular sleeves, may be at least partially disposed in the casing 20. The sleeves, as shown in FIG. 1, extend axially along a generally longitudinal axis 90, such that the inlet of a sleeve is axially aligned with the outlet. For example, a combustor liner 22 may generally define a combustion zone 24 therein. Combustion of the working fluid, fuel, and optional oxidizer may generally occur in the combustion zone 24. The resulting hot gases of combustion may flow generally axially along the longitudinal axis 42 downstream through the combustion liner 22 into a transition piece 26, and then flow generally axially along the longitudinal axis 90 through the transition piece 26 and into the turbine section 18.

The combustor 16 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

As shown in FIGS. 2 through 12, a combustor 16 according to the present disclosure may include a transition duct 50 extending between the fuel nozzle 40 or fuel nozzles 40 and the turbine section 18. The transition ducts 50 of the present disclosure may be provided in place of various axially extending sleeves of other combustors. For example, a transition duct 50 may replace the axially extending combustor liner 22 and transition piece 26 of a combustor, and, as discussed below, may provide various advantages over the axially extending combustor liners 22 and transition pieces 26 for flowing working fluid therethrough and to the turbine section 18.

As shown, the plurality of transition ducts 50 may be disposed in an annular array about longitudinal axis 90. Further, each transition duct 50 may extend between a fuel nozzle 40 or plurality of fuel nozzles 40 and the turbine section 18. For example, each transition duct 50 may extend from the fuel nozzles 40 to the transition section 18. Thus, working fluid may flow generally from the fuel nozzles 40 through the transition duct 50 to the turbine section 18. In some embodiments, the transition ducts 50 may advantageously allow for the elimination of the first stage nozzles in the turbine section, which may eliminate any associated drag and pressure drop and increase the efficiency and output of the system 10.

Each transition duct 50 may have an inlet 52, an outlet 54, and a passage 56 therebetween. The inlet 52 and outlet 54 of a transition duct 50 may have generally circular or oval cross-sections, rectangular cross-sections, triangular cross-sections, or any other suitable polygonal cross-sections. Further, it should be understood that the inlet 52 and outlet 54 of a transition duct 50 need not have similarly shaped cross-sections. For example, in one embodiment, the inlet 52 may have a generally circular cross-section, while the outlet 54 may have a generally rectangular cross-section.

Further, the passage 56 may be generally tapered between the inlet 52 and the outlet 54. For example, in an exemplary embodiment, at least a portion of the passage 56 may be generally conically shaped. Additionally or alternatively, however, the passage 56 or any portion thereof may have a generally rectangular cross-section, triangular cross-section, or any other suitable polygonal cross-section. It should be understood that the cross-sectional shape of the passage 56 may change throughout the passage 56 or any portion thereof as the passage 56 tapers from the relatively larger inlet 52 to the relatively smaller outlet 54.

In some embodiments, as shown in FIGS. 4 through 7, a transition duct 50 according to the present disclosure may comprise an aft frame 58. The aft frame 58 may generally be a flange-like frame surrounding the exterior of the transition duct 50. The aft frame 58 may be located generally adjacent to the outlet 54. Further, the aft frame 58, while adjacent to the outlet 54, may be spaced from the outlet 54, or may be provided at the outlet to connect the transition duct 50 to the turbine section 18.

As mentioned above, the plurality of transition ducts 50 may be disposed in an annular array about longitudinal axis 90. Thus, any one or more of the transition ducts 50 may be referred to as a first transition duct 62, and a transition duct 50 adjacent to the first transition duct 62, such as adjacent in the annular array, may be referred to as a second transition duct 64.

The outlet 54 of each of the plurality of transition ducts 50 may be offset from the inlet 52 of the respective transition duct 50. The term "offset", as used herein, means spaced from along the identified coordinate direction. The outlet 54 of each of the plurality of transition ducts 50 may be longitudinally offset from the inlet 52 of the respective transition duct 50, such as offset along the longitudinal axis 90.

Additionally, in exemplary embodiments, the outlet 54 of each of the plurality of transition ducts 50 may be tangentially offset from the inlet 52 of the respective transition duct 50, such as offset along a tangential axis 92. Because the outlet 54 of each of the plurality of transition ducts 50 is tangentially offset from the inlet 52 of the respective transition duct 50, the transition ducts 50 may advantageously utilize the tangential component of the flow of working fluid through the transition ducts 30 to eliminate the need for first stage nozzles (not shown) in the turbine section 18.

Further, in exemplary embodiments, the outlet 54 of each of the plurality of transition ducts 50 may be radially offset from the inlet 52 of the respective transition duct 50, such as offset along a radial axis 94. Because the outlet 54 of each of the plurality of transition ducts 50 is radially offset from the inlet 52 of the respective transition duct 50, the transition ducts 50 may advantageously utilize the radial component of the flow of working fluid through the transition ducts 30 to further eliminate the need for first stage nozzles (not shown) in the turbine section 18.

Figure 2:
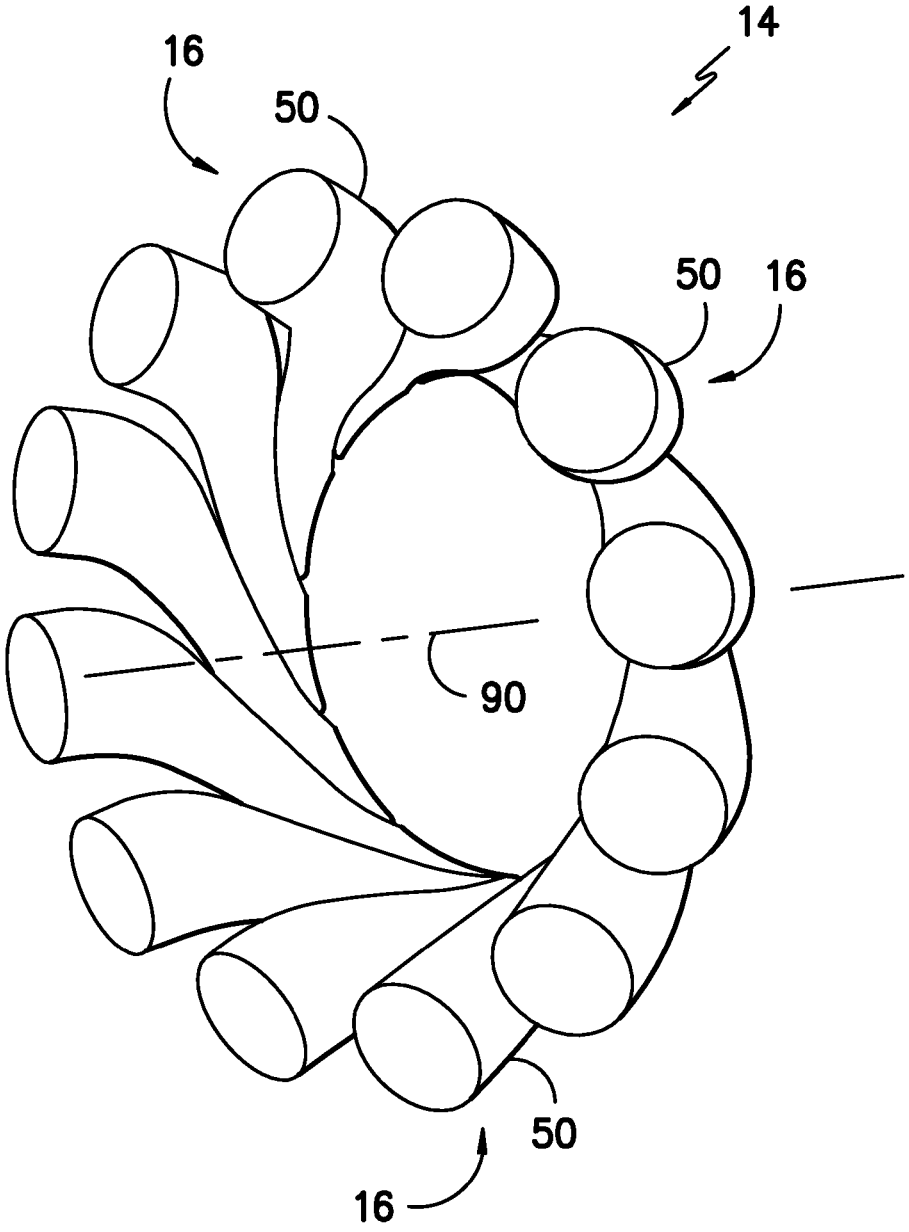
FIG. 2 is a perspective view of an annular array of transition ducts according to one embodiment of the present disclosure.

It should be understood that the tangential axis 92 and the radial axis 94 are defined individually for each transition duct 50 with respect to the circumference defined by the annular array of transition ducts 50, as shown in FIG. 2, and that the axes 92 and 94 vary for each transition duct 50 about the circumference based on the number of transition ducts 50 disposed in an annular array about the longitudinal axis 90.

During operation of the system 10, each transition duct 50 may experience thermal growth and/or other various interactions that cause movement of the transition ducts 50 about and/or along various of the axes. Loads incurred by the transition ducts 50 during such operation must be transferred and thus reacted between adjacent ducts 50 in order to prevent damage or failure to the ducts 50.

Thus, the present disclosure is further directed to a load member 100 and a loading assembly 102 for a turbine system 10. The loading assembly 102 may comprise the transition duct 50 or transition ducts 50 extending between the fuel nozzle 40 and turbine section 18, and a load member 100 or load members 100. Each load member 100 may extend from a transition duct 50, such as from a first transition duct 62 or second transition duct 64. In some embodiments, for example, a load member 100 may be integral with the transition duct 50. In these embodiments, the load member 100 and transition duct 50 are formed as a singular component. In other embodiments, the load member 100 may be mounted to the transition duct 50. For example, the load member 100 may be welded, soldered, adhered with a suitable adhesive, or fastened with suitable mechanical fasteners such as rivet, nut/bolt combination, nail, or screw, to the transition duct 50.

Each load member 100 may be configured to transfer a load between a transition duct 50 and an adjacent transition duct 50, such as between first and second transition ducts 62 and 64. For example, the load members 100 may be sized such that the load member 100 contacts the adjacent transition duct 50 during operation of the system 10, when the transition duct 50 incurs a load about or along a certain axis or axes. When this loading occurs, the transition duct 50 may shift. This shift and the associated load may be transferred through the contact between the load member 100 and the adjacent transition duct 50 to the adjacent transition duct 50. Thus, the load members 100 advantageously react various loads between the various transition ducts 50 in the system 10.

In general, the load members 100 may have any suitable cross-sectional shape, such as rectangular or square, oval or circular, triangular, or any other suitable polygonal cross-sectional shape. Further, the load members 100 may have any size suitable for contacting adjacent transition ducts 50 during operation, and transferring loads between the adjacent transition ducts 50.

A load may be transferred by a load member 100 along any of the longitudinal axis 90, the tangential axis 92, or the radial axis 94. For example, FIGS. 3 through 6 illustrate various embodiments of a load member 100 configured to transfer a load along tangential axis 92. During operation, a transition duct 50, such as first transition duct 62, may move along the tangential axis 92, such as because of twisting about the longitudinal axis 90 and/or radial axis 94. When this occurs, the load member 100 extending from the transition duct 50 may contact the adjacent transition duct 50 and transfer at least a portion of this load to the adjacent transition duct, such as second transition duct 64. In exemplary embodiments, this loading may occur for each transition duct 50 with respect to the adjacent transition duct 50 in the annular array of transition ducts 50, such that the loads on the transition ducts 50 in the system are reacted and transferred generally evenly throughout the annular array.

Figure 3:
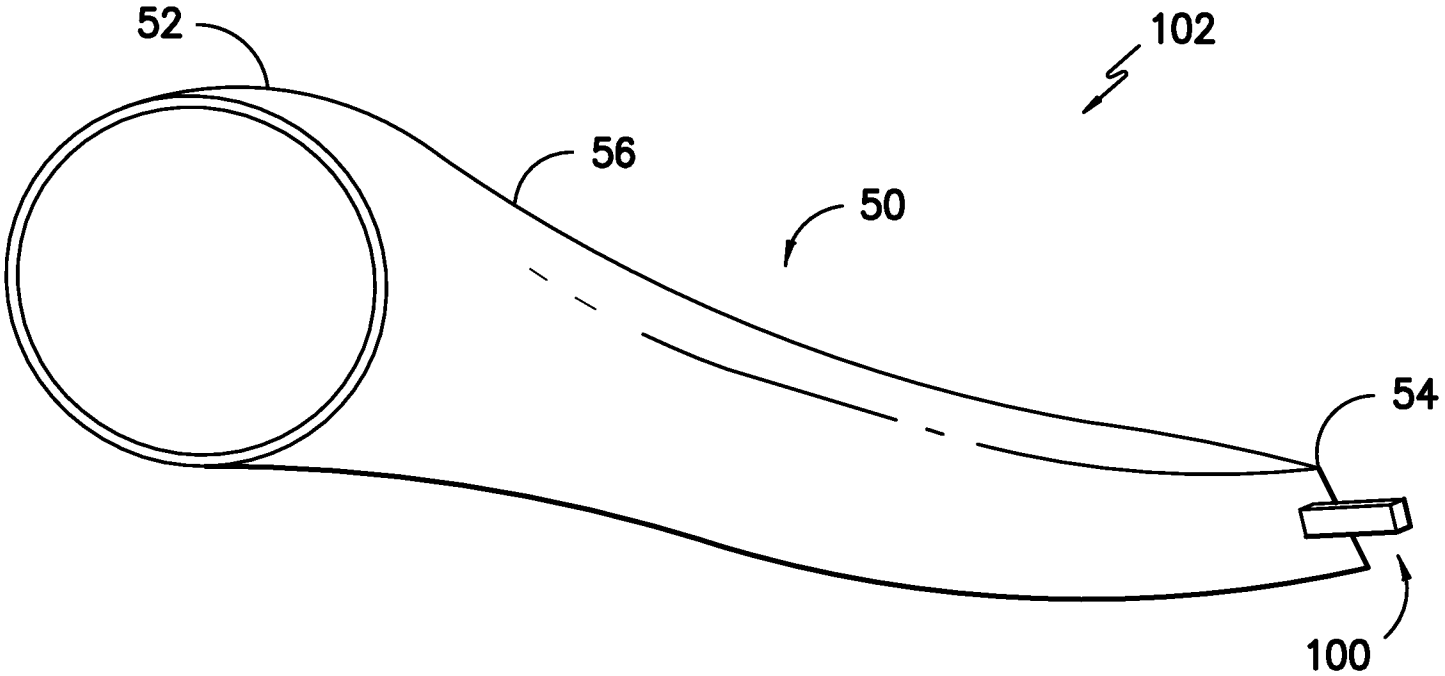
FIG. 3 is a rear right side perspective view of a loading assembly according to one embodiment of the present disclosure.
Figure 4:
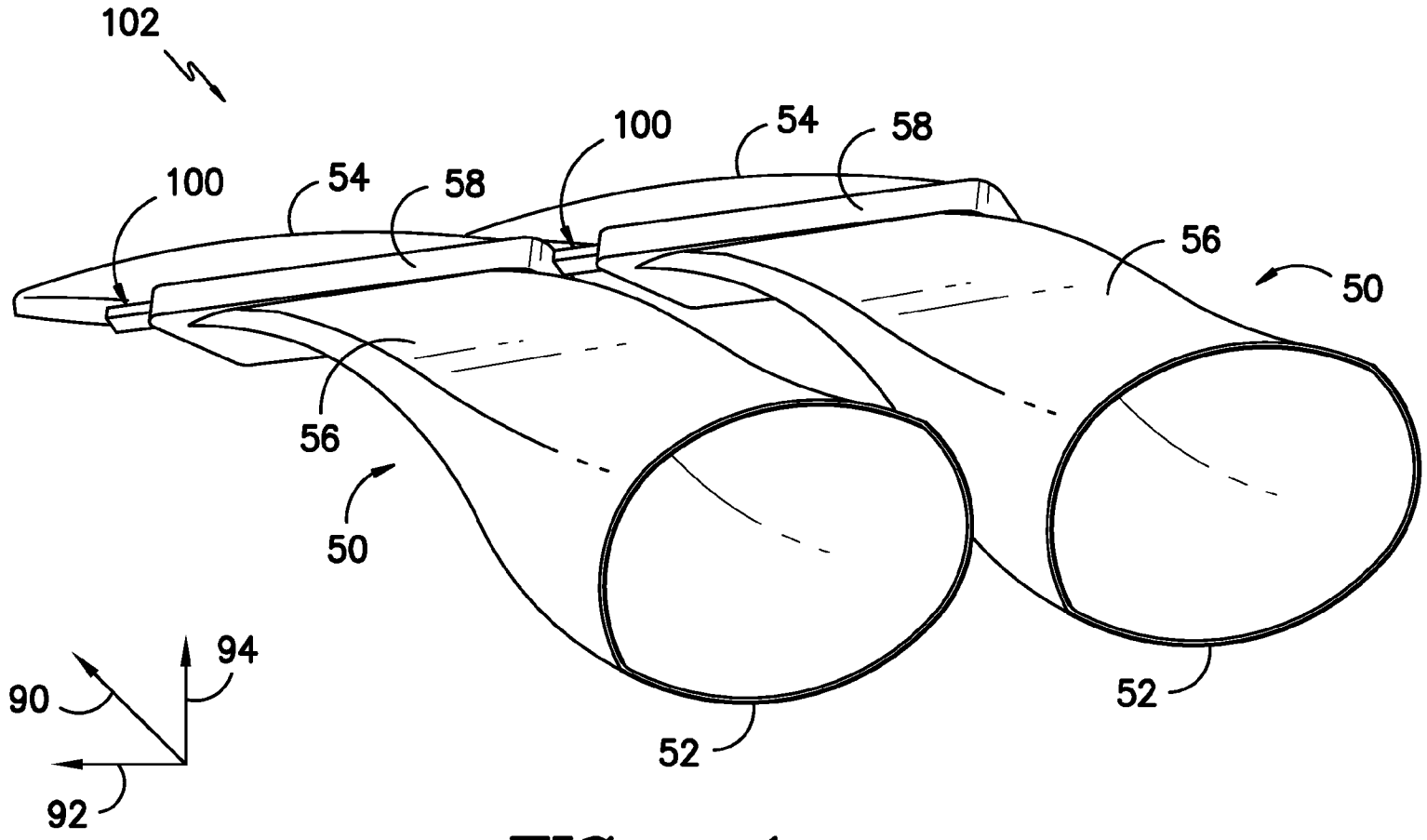
FIG. 4 is a rear left side perspective view of a loading assembly according to another embodiment of the present disclosure.

FIGS. 3 through 5 illustrate a load member 100 extending from a transition duct, such as first transition duct 62, and configured to transfer a load along tangential axis 92 between the transition duct 50 and an adjacent transition duct 50, such as second transition duct 64. FIG. 6 illustrates a first load member 112 and a second load member 114. The first load member 112 extends from a first transition duct 62, while the second load member extends from a second transition duct 64. Each of the first load member 112 and second load member 114 are configured to transfer a load along tangential axis 92 between the first transition duct 62 and the second transition duct 64, such as second transition duct 64. Further, it should be understood that any suitable number of load members 100 may be provided extending from a transition duct 50, an adjacent transition duct 50, or both, to transfer loads along the tangential axis 92 as required.

As shown in FIG. 6, the first load member 112 and second load member 114 may further be configured to transfer a load along the longitudinal axis 90. For example, during operation, a transition duct 50, such as first transition duct 62, may move along the longitudinal axis 90, such as because of twisting about the tangential axis 92 and/or radial axis 94. When this occurs, the first load member 112 extending from the first transition duct 62 may contact the second load member 114 extending from the second transition duct 64 and transfer at least a portion of this load to the second load member 114. In exemplary embodiments, this loading may occur for each transition duct 50 with respect to the adjacent transition duct 50 in the annular array of transition ducts 50, such that the loads on the transition ducts 50 in the system are reacted and transferred generally evenly throughout the annular array.

FIGS. 7 and 8 illustrate various embodiments of a load member 100 configured to transfer a load along longitudinal axis 90. During operation, a transition duct 50, such as first transition duct 62, may move along the longitudinal axis 90, such as because of twisting about the tangential axis 92 and/or radial axis 94. When this occurs, the load member 100 extending from the transition duct 50 may contact the adjacent transition duct 50 and transfer at least a portion of this load to the adjacent transition duct, such as second transition duct 64. In exemplary embodiments, this loading may occur for each transition duct 50 with respect to the adjacent transition duct 50 in the annular array of transition ducts 50, such that the loads on the transition ducts 50 in the system are reacted and transferred generally evenly throughout the annular array.

FIG. 7 illustrates a load member 100 extending from a transition duct, such as first transition duct 62, and configured to transfer a load along longitudinal axis 90 between the transition duct 50 and an adjacent transition duct 50, such as second transition duct 64. FIG. 8 illustrates a first load member 112 and a second load member 114. The first load member 112 extends from a first transition duct 62, while the second load member extends from a second transition duct 64. Each of the first load member 112 and second load member 114 are configured to transfer a load along longitudinal axis 90 between the first transition duct 62 and the second transition duct 64, such as second transition duct 64. Further, it should be understood that any suitable number of load members 100 may be provided extending from a transition duct 50, an adjacent transition duct 50, or both, to transfer loads along the longitudinal axis 90 as required.

As shown in FIG. 8, the first load member 112 and second load member 114 may further be configured to transfer a load along the tangential axis 92. For example, during operation, a transition duct 50, such as first transition duct 62, may move along the tangential axis 92, such as because of twisting about the longitudinal axis 90 and/or radial axis 94. When this occurs, the first load member 112 extending from the first transition duct 62 may contact the second load member 114 extending from the second transition duct 64 and transfer at least a portion of this load to the second load member 114. In exemplary embodiments, this loading may occur for each transition duct 50 with respect to the adjacent transition duct 50 in the annular array of transition ducts 50, such that the loads on the transition ducts 50 in the system are reacted and transferred generally evenly throughout the annular array.

FIGS. 9 and 10 illustrate further various embodiments of a load member 100 configured to transfer a load along tangential axis 92. During operation, a transition duct 50, such as first transition duct 62, may move along the tangential axis 92, such as because of twisting about the longitudinal axis 90 and/or radial axis 94. When this occurs, the load member 100 extending from the transition duct 50 may contact the adjacent transition duct 50 and transfer at least a portion of this load to the adjacent transition duct, such as second transition duct 64. In exemplary embodiments, this loading may occur for each transition duct 50 with respect to the adjacent transition duct 50 in the annular array of transition ducts 50, such that the loads on the transition ducts 50 in the system are reacted and transferred generally evenly throughout the annular array.

FIG. 9 illustrates a load member 100 extending from a transition duct, such as first transition duct 62, and configured to transfer a load along tangential axis 92 between the transition duct 50 and an adjacent transition duct 50, such as second transition duct 64. FIG. 10 illustrates a first load member 112 and a second load member 114. The first load member 112 extends from a first transition duct 62, while the second load member extends from a second transition duct 64. Each of the first load member 112 and second load member 114 are configured to transfer a load along tangential axis 92 between the first transition duct 62 and the second transition duct 64, such as second transition duct 64. Further, it should be understood that any suitable number of load members 100 may be provided extending from a transition duct 50, an adjacent transition duct 50, or both, to transfer loads along the tangential axis 92 as required.

As shown in FIG. 10, the first load member 112 and second load member 114 may further be configured to transfer a load along the radial axis 94. For example, during operation, a transition duct 50, such as first transition duct 62, may move along the radial axis 94, such as because of twisting about the longitudinal axis 90 and/or tangential axis 92. When this occurs, the first load member 112 extending from the first transition duct 62 may contact the second load member 114 extending from the second transition duct 64 and transfer at least a portion of this load to the second load member 114. In exemplary embodiments, this loading may occur for each transition duct 50 with respect to the adjacent transition duct 50 in the annular array of transition ducts 50, such that the loads on the transition ducts 50 in the system are reacted and transferred generally evenly throughout the annular array.

It should further be understood that the present disclosure is not limited to load members 100 configured to transfer loads mainly along only one axis. For example, the above various embodiments disclose various load members 100 configured to transfer loads mainly along one axis because of movement about another axis. However, it should be understood that movement may occur about or along more than one axis at once, and that any of the above disclosed embodiments of various load members 100 may transfer loads along any number of axes based on this movement.

Further, in some embodiments, a load member 100 may extend from a transition duct 50 according to the present disclosure and be configured to transfer loads along more than one of the longitudinal axis 90, the tangential axis 92, and the radial axis 94. For example, as shown in FIGS. 11 and 12, a load member 100 or first and second load members 112 and 114 may extend from the transition duct 50 or first and second transition ducts 62 and 64 and contact the adjacent respective transition ducts 50 at an angle between the longitudinal axis 90 and the tangential axis 92. These load members 100 may thus transfer loads along both the longitudinal axis 90 and the tangential axis 92.

In some embodiments, as shown in FIGS. 4 through 8, 11, and 12, the load members 100 may extend from an aft frame 58 of the transition duct 50. In other embodiments, as shown in FIGS. 3, 9, and 10, the load members 100 may simply extend from the passage 56 of the transition duct 50.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A loading assembly for a turbine system, the loading assembly comprising:

a gas turbine engine;

a transition duct extending between a fuel nozzle and a turbine section of the gas turbine engine, the transition duct having an inlet, an outlet and a passage extending between the inlet and the outlet and defining a longitudinal axis, a radial axis, and a tangential axis, the outlet of the transition duct offset from the inlet along the longitudinal axis and the tangential axis; and a load member extending from the transition duct between the inlet and the outlet and located downstream of a combustion zone and configured to transfer a load between the transition duct and an adjacent transition duct along at least one of the longitudinal axis, the radial axis, or the tangential axis, the load member comprising a cantilevered body extending between a first end connected to a wall of the transition duct and a second free end;

wherein a length of the load member extends transverse to the wall of the transition duct; and wherein when the load is transferred from the transition duct to the adjacent transition duct, the second free end contacts a wall of the adjacent transition duct.

2. The loading assembly of claim 1, wherein the outlet of the transition duct is further offset from the inlet along the radial axis.

3. The loading assembly of claim 1, wherein the load member is configured to transfer the load between the transition duct and the adjacent transition duct along the longitudinal axis.

4. The loading assembly of claim 1, wherein the load member is configured to transfer the load between the transition duct and the adjacent transition duct along the tangential axis.

5. The loading assembly of claim 1, wherein the load member is configured to transfer the load between the transition duct and the adjacent transition duct along the longitudinal axis and the tangential axis.

6. The loading assembly of claim 1, wherein the load member is integral with the transition duct.

7. The loading assembly of claim 1, wherein the load member is mounted to the transition duct.

8. The loading assembly of claim 1, further comprising a plurality of load members extending from the transition duct, each of the plurality of load members configured to transfer a load between the transition duct and an adjacent transition duct along at least one of the longitudinal axis, the radial axis, or the tangential axis.

9. The loading assembly of claim 1, further comprising a plurality of transition ducts and a plurality of load members, each of the plurality of transition ducts disposed annularly about a central longitudinal axis, each of the plurality of load members extending from one of the plurality of transition ducts and configured to transfer a load between the transition duct and an adjacent transition duct.

10. A loading assembly for a turbine system, the loading assembly comprising:

a gas turbine engine;

a first transition duct and a second transition duct of the gas turbine engine, extending between a fuel nozzle and a turbine section, the first and second transition ducts each having an inlet, an outlet and a passage extending between the inlet and the outlet and defining a longitudinal axis, a radial axis, and a tangential axis, the outlet of the each of first and second transition ducts offset from the respective inlet along the respective longitudinal axis and the respective tangential axis; and a first load member extending from the first transition duct between the inlet and the outlet and located downstream of a combustion zone and configured to transfer a load between the first transition duct and the second transition duct along at least one of the longitudinal axis, the radial axis, or the tangential axis, the first load member comprising a cantilevered body extending between a first end connected to a wall of the first transition duct and a second free end;

wherein a length of the first load member extends transverse to the wall of the first transition duct; and wherein when the load is transferred between the first and second transition ducts, the second free end contacts a wall of the second transition duct.

11. The loading assembly of claim 10, further comprising a second load member extending from the other of the first transition duct or the second transition duct and configured to transfer a load between the first transition duct and the second transition duct along at least one of the longitudinal axis, the radial axis, or the tangential axis.

12. The loading assembly of claim 10, wherein the outlet of each of the first and second transition ducts is further offset from the respective inlet along the respective radial axis.

13. The loading assembly of claim 10, wherein the first load member is configured to transfer the load between the first transition duct and the second transition duct along the longitudinal axis.

14. The loading assembly of claim 10, wherein the first load member is configured to transfer the load between the first transition duct and the second transition duct along the tangential axis.

15. The loading assembly of claim 10, wherein the first load member is configured to transfer the load between the first transition duct and the second transition duct along the longitudinal axis and tangential axis.

16. The loading assembly of claim 10, wherein the first load member is integral with the transition duct.

17. The loading assembly of claim 10, wherein the first load member is mounted to the transition duct.

18. The loading assembly of claim 10, further comprising a plurality of first load members extending from the transition duct, each of the plurality of first load members configured to transfer a load between the first transition duct and the second transition duct along at least one of the longitudinal axis, the radial axis, or the tangential axis.

19. A turbine system, comprising:

a gas turbine engine;

a fuel nozzle;

a turbine section;

a transition duct extending between the fuel nozzle and the turbine section of the gas turbine engine, the transition duct having an inlet, an outlet and a passage extending between the inlet and the outlet and defining a longitudinal axis, a radial axis, and a tangential axis, the outlet of the transition duct offset from the inlet along the longitudinal axis and the tangential axis; and a load member extending from the transition duct between the inlet and the outlet and located downstream of a combustion zone and configured to transfer a load between the transition duct and an adjacent transition duct along at least one of the longitudinal axis, the radial axis, or the tangential axis, the load member comprising a cantilevered body extending between a first end connected to a wall of the transition duct and a second free end;

wherein a length of the load member extends transverse to the wall of the transition duct; and wherein when the load is transferred from the transition duct to the adjacent transition duct, the second free end contacts a wall of the adjacent transition duct.

20. The turbine system of claim 19, further comprising a plurality of transition ducts and a plurality of load members, each of the plurality of transition ducts disposed annularly about the longitudinal axis, each of the plurality of load members extending from one of the plurality of transition ducts and configured to transfer a load between the transition duct and an adjacent transition duct.

* * * * *